US006120096A

United States Patent [19]

Miotto

[11] Patent Number: 6,120,096

[45] Date of Patent: Sep. 19, 2000

[54] MECHANICAL DEVICE FOR SYNCHRONOUS MOVEMENT OF THE BACKREST AND SEAT OF A CHAIR

[75] Inventor: Beniamino Miotto, Roncade, Italy

[73] Assignee: NOWY STYL sp.zo.o.j.v., Krosno, Poland

[21] Appl. No.: 09/352,137

[22] Filed: Jul. 13, 1999

[30] Foreign Application Priority Data

Jul. 16, 1998 [IT] Italy ..... TV980026 U

[51] Int. Cl.[7] ..... A47C 1/024

[52] U.S. Cl. ..... 297/301.4; 297/300.1; 297/300.2; 297/300.5

[58] Field of Search ..... 297/301.4, 300.5, 297/300.2, 300.1

[56] References Cited

U.S. PATENT DOCUMENTS

| | | | |
|---|---|---|---|
| 4,636,004 | 1/1987 | Neumuller | 297/300.5 X |
| 4,830,431 | 5/1989 | Inoue | 297/300.5 |
| 5,228,748 | 7/1993 | Neumuller | 297/300.1 X |
| 5,348,371 | 9/1994 | Miotto | 297/300.4 |
| 5,447,357 | 9/1995 | Dauphin | 297/301.4 |
| 5,564,783 | 10/1996 | Elzenbeck et al. | 297/300.5 X |
| 5,573,303 | 11/1996 | Doerner | 297/300.5 |
| 5,584,533 | 12/1996 | Shrewe | 297/300.5 X |
| 5,658,045 | 8/1997 | Van Koolwijk et al. | 297/301.4 X |
| 5,664,834 | 9/1997 | Hsu | 297/30.5 X |
| 5,725,276 | 3/1998 | Ginat | 297/301.4 X |
| 5,918,935 | 7/1999 | Stulik et al. | 297/301.4 X |
| 5,931,531 | 8/1999 | Assmann | 297/300.2 X |

*Primary Examiner*—Peter M. Cuomo
*Assistant Examiner*—Rodney B. White
*Attorney, Agent, or Firm*—Daniel O'Byrne

[57] ABSTRACT

A mechanical device for synchronous movement of a seat and a backrest of a chair comprising a first supporting bracket which is associated with a central column which protrudes from a rotating base and is pivoted transversely to an end of a second fixing bracket for the seat. The second bracket cooperates with two pairs of slotted laminar elements which are pivoted to the first bracket. A third anchoring bracket for the backrest is also provided which is pivoted to the first bracket and to a pair of linkages which are in turn pivoted to the second bracket. Moreover, a piston is present between the third and first brackets and a pair of springs is present between the first and second brackets.

11 Claims, 6 Drawing Sheets

MECHANICAL DEVICE FOR SYNCHRONOUS MOVEMENT OF THE BACKREST AND SEAT OF A CHAIR

BACKGROUND OF THE INVENTION

The present invention relates to a mechanical device which can be used in particularly to achieve the synchronous movement of a seat with respect to the backrest of a chair.

As it is commonly known, the seat and the backrest of conventional chairs are provided on separate frames which are interconnected so that an inclination applied to the backrest is matched by a movement of the seat along an axis which is approximately parallel to the ground resting axis of the chair.

This solution is not ergonomic, since the user is subjected to pressure at the calves.

Moreover, the backrest of conventional chairs can oscillate with respect to the seat, which is fixed: even these solutions, however, are not ideal, since this inclination of the backrest can make the user slide at the seat, producing a condition which is ergonomically incorrect and possibly lifting the user's clothing at the backrest. U.S. Pat. No. 5,348,371 discloses a partial solution to this drawback, by providing a mechanical device for the synchronous movement of the seat and backrest of a chair, which substantially comprises a first support bracket pivoted, at one end, transversely to a corresponding end of a second fixing bracket for a seat, which is pivoted at the other end, transversely and eccentrically with respect to the axis of a central column which protrudes from a rotating base, to a third anchoring bracket for the backrest; said anchoring bracket has, at one end, slotted guides for its oscillation with respect to the first and second brackets and means for selectively locking the mutual position of the first, second and third brackets.

Although this solution is undoubtedly valid, it has drawbacks: the slotted shape of the end of the third bracket is a weak point of the structure, in that in order to comply with recent standards and the associated fatigue tests it is necessary to consider a thermal treatment of said ends in order to harden them and therefore ensure that they are not subject to deformations or breakage.

A further drawback that can be observed in this conventional embodiment is the fact that the movement of the backrest with respect to the chair is not always gradual and is sometimes sudden.

A further drawback of this prior art is the fact that at the first bracket there is an anchoring bush for the central column, a spring being arranged coaxially thereto and being accordingly interposed between the first bracket and the second bracket; this may causes the mutual movement of the first, second and third brackets not to be gradual.

SUMMARY OF THE INVENTION

The aim of the present invention is to solve the abovementioned problems, eliminating the drawbacks of the cited prior art and thus providing a mechanical device which allows to achieve optimum and gradual synchronous movement of the seat and of the backrest of a chair which has low manufacturing costs while allowing to pass current fatigue tests prescribed by standards.

Within the scope of this aim, an important object is to provide a mechanical device in which the movement of the backrest with respect to the seat can occur gradually and therefore without sudden oscillations.

A further important object is to provide a mechanical device in which the mutual movement of its various components can occur in an optimum manner without sticking.

A further object is to provide a mechanical device which is structurally simple and has low manufacturing costs.

This aim, these objects and others which will become apparent hereinafter are achieved by a mechanical device particularly for the synchronous movement of the seat and backrest of a chair, comprising a first supporting bracket which is associated with a central column which protrudes from a rotating base and is pivoted transversely to an end of a second fixing bracket for said seat which cooperates with two pairs of slotted laminar elements which are pivoted to said first bracket and comprising a third anchoring bracket for said backrest, characterized in that said third bracket is pivoted to said first bracket and to a pair of linkages which are in turn pivoted to said second bracket, a piston being interposed between said third and first brackets, a pair of springs being interposed between said first and second brackets.

BRIEF DESCRIPTION OF THE DRAWINGS

Further characteristics and advantages of the invention will become apparent from the following detailed description of a particular but not exclusive embodiment, illustrated only by way of nonlimitative example in the accompanying drawings, wherein.

DESCRIPTION OF THE PREFERRED EMBODIMENTS

Figure 1:
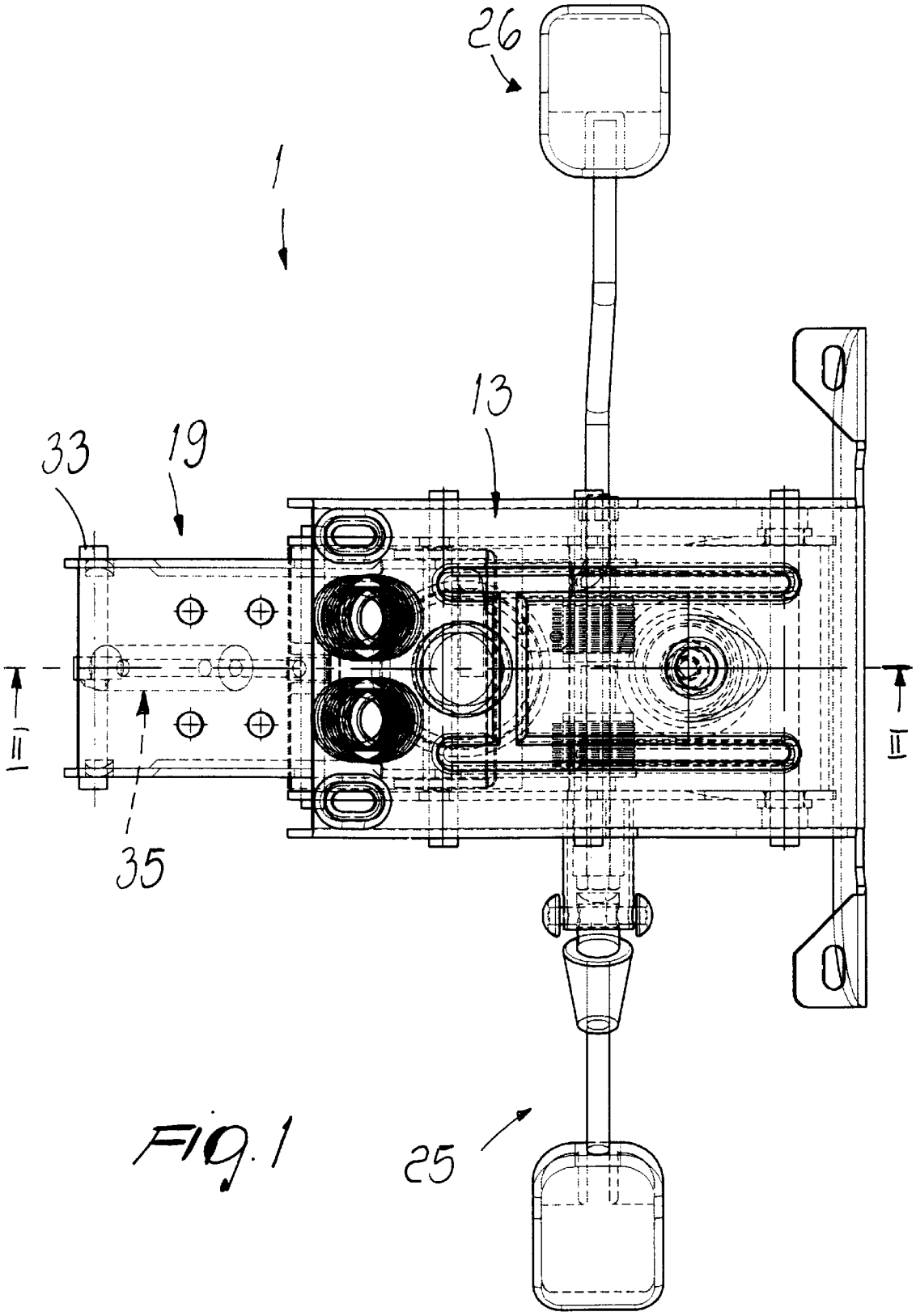
FIG. 1 is a top view of the mechanical device, according to the invention, showing some of its internal components.
Figure 2:
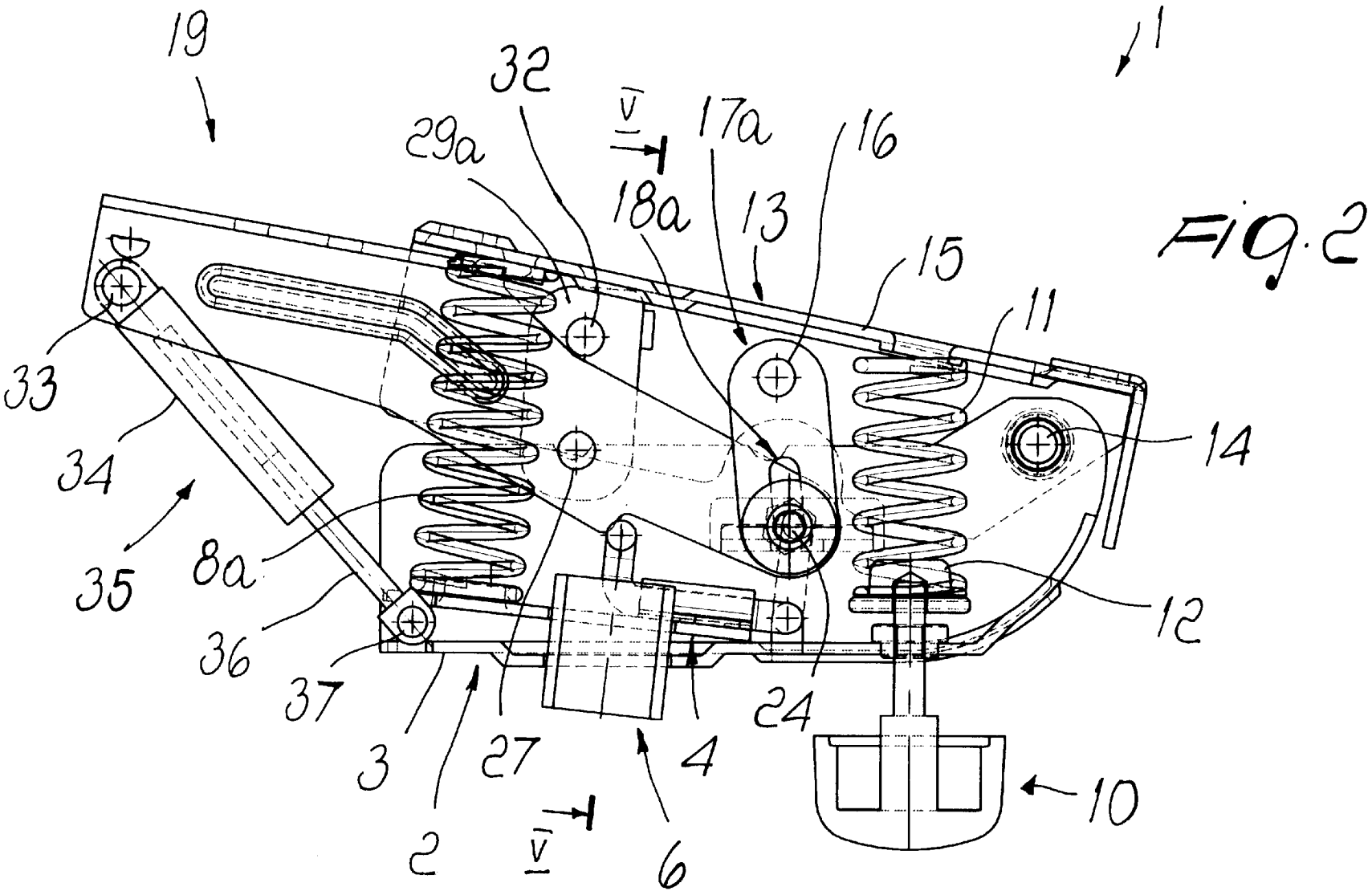
FIG. 2 is a sectional view, taken along the plane II—II of FIG. 1, in the condition which the seat and the backrest are tilted forward.
Figure 3:
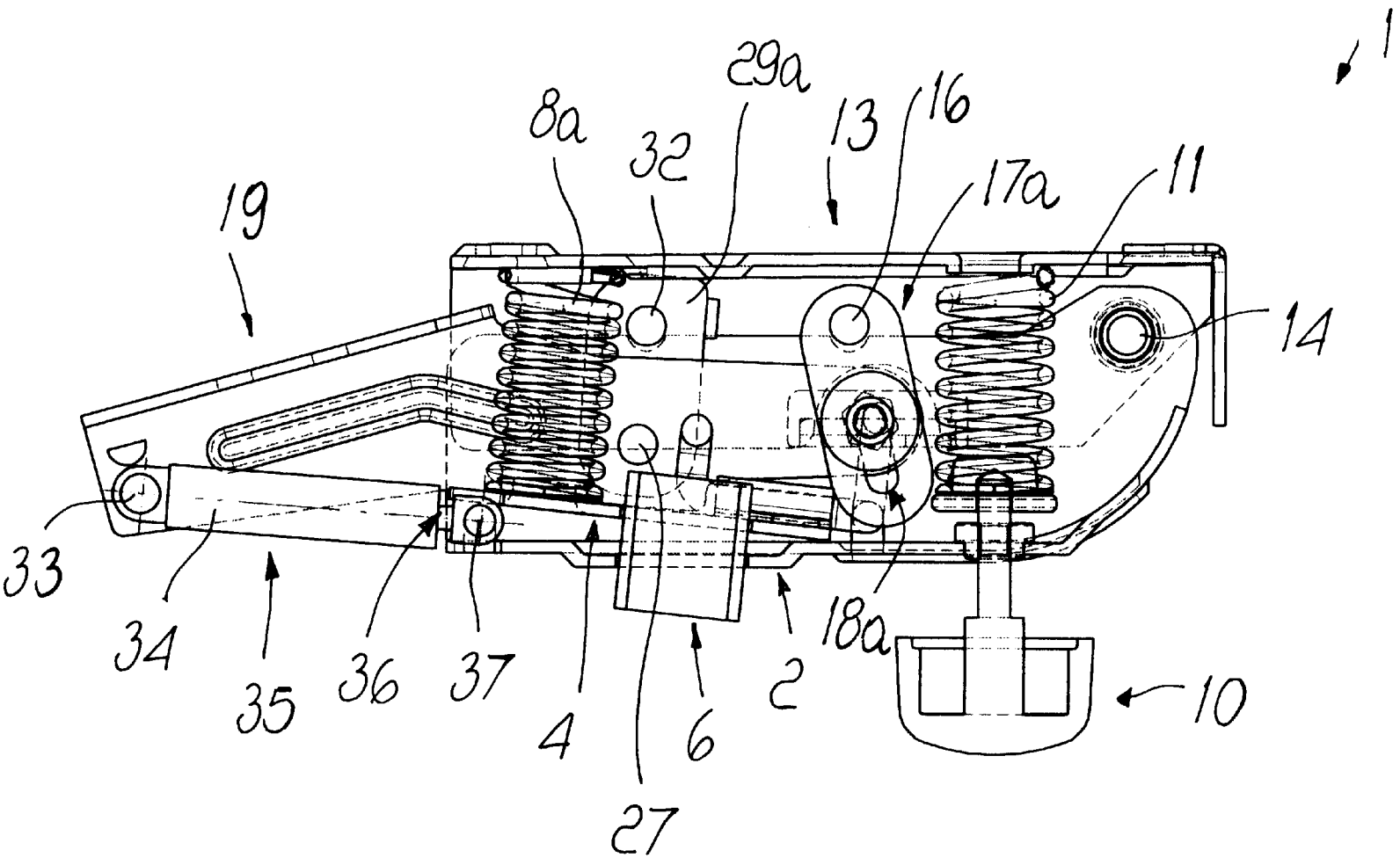
FIG. 3 is a view, similar to FIG. 2, of the condition in which the seat and the backrest are tilted backward.
Figure 4:
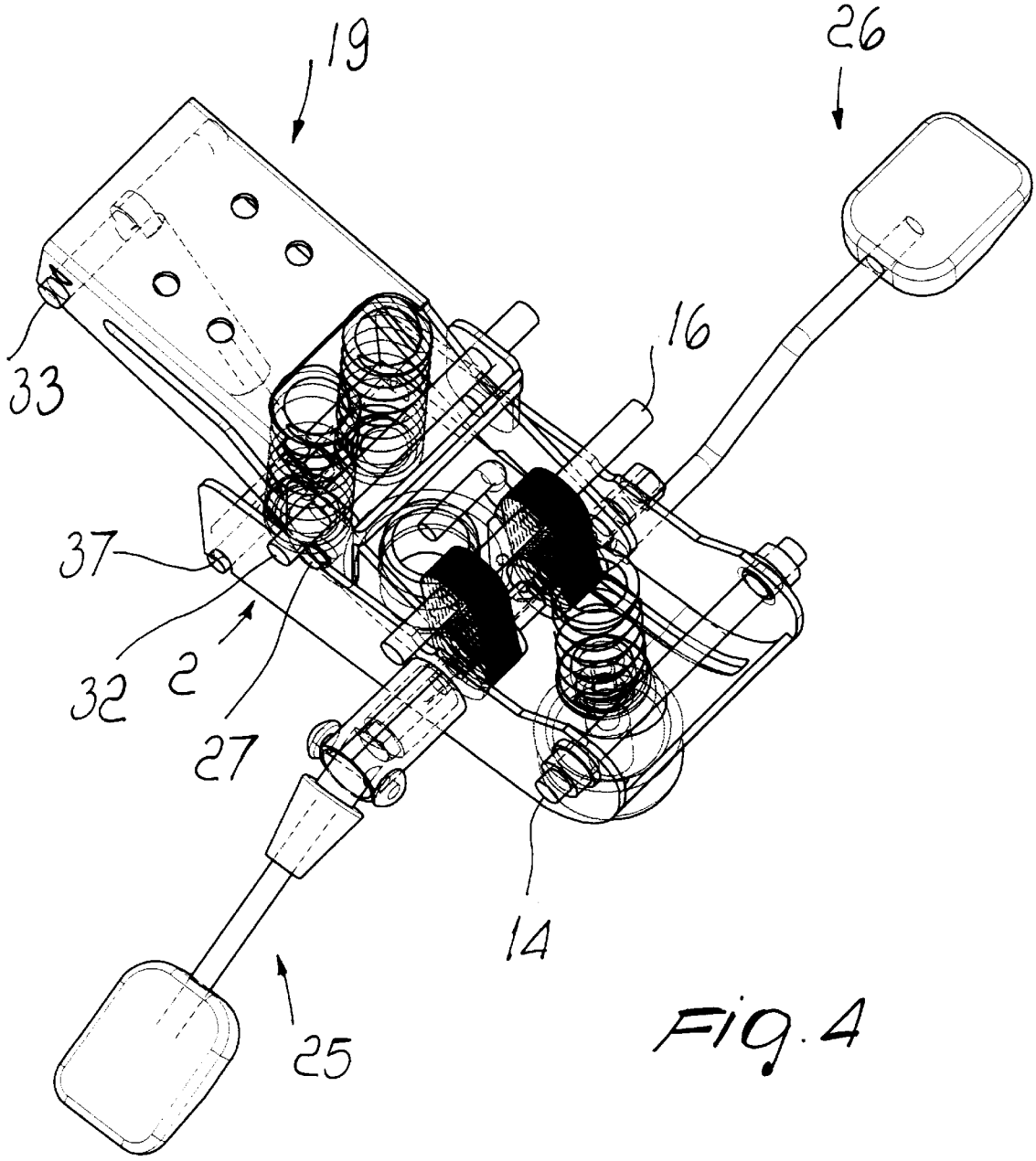
FIG. 4 is a top perspective view of the mechanical device, in which the second bracket has been removed for the sake of clarity.
Figure 5:
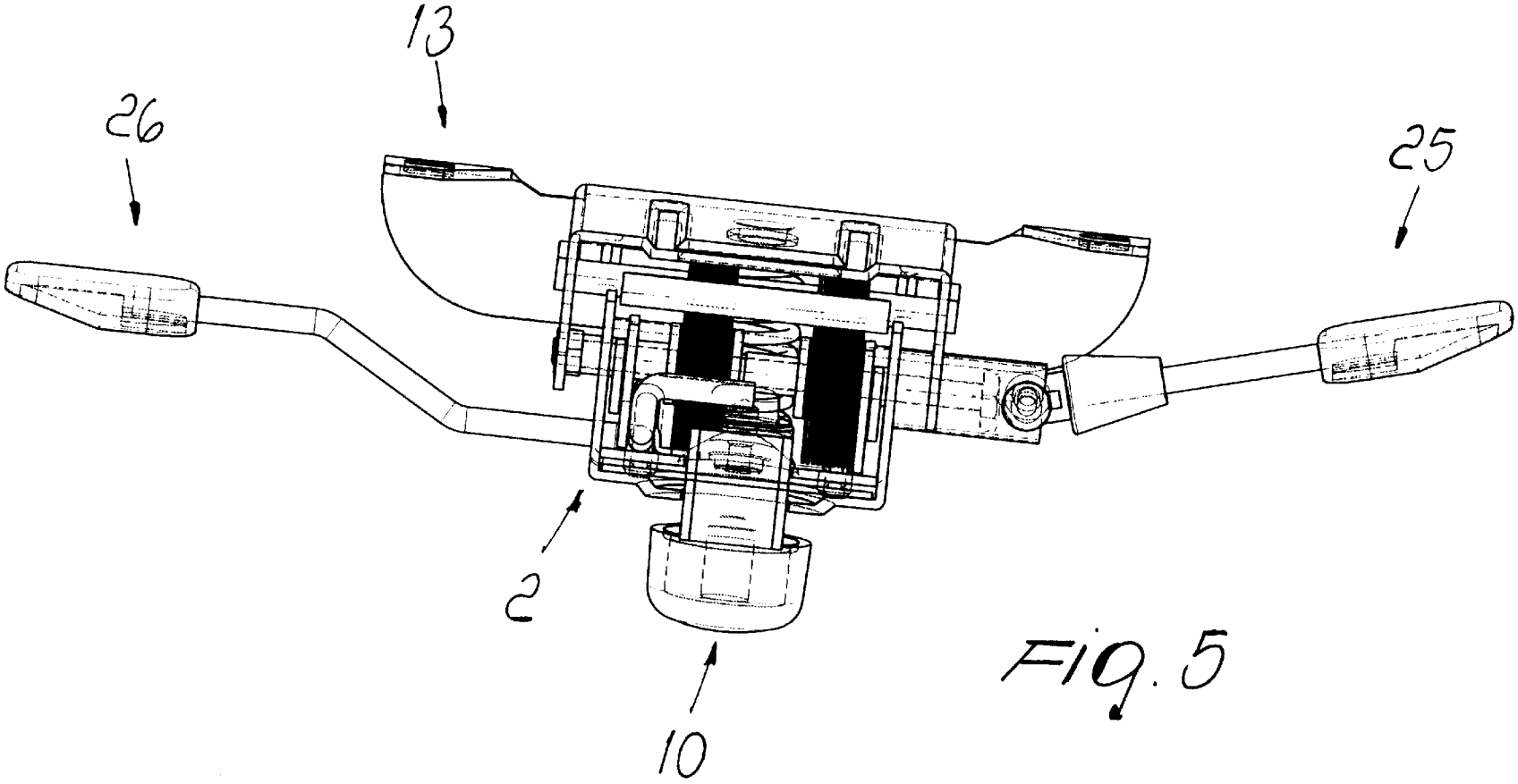
FIG. 5. is a sectional view, taken along the plane V—V of FIG. 2.

With reference to the above figures, the reference numeral 1 designates the mechanical device, which is used particularly to achieve the synchronous movement of a seat and a backrest, not shown, of a chair.

The mechanical device comprises a first supporting bracket 2 which has an essentially box-like structure and forms a first base 3 above which a plate 4 is arranged along part of its length.

Both the first base 3 and the plate 4 have a first hole, designated by the reference numerals 5*a* and 5*b*, for positioning a bush 6 at which the end of the stem of a wheeled central column is associated.

The plate 4 is slightly inclined with respect to the first base 3 and forms an acute angle therewith, considering a counterclockwise rotation as positive and a vertex directed away from the first holes 5*a* and 5*b*.

Figure 6:
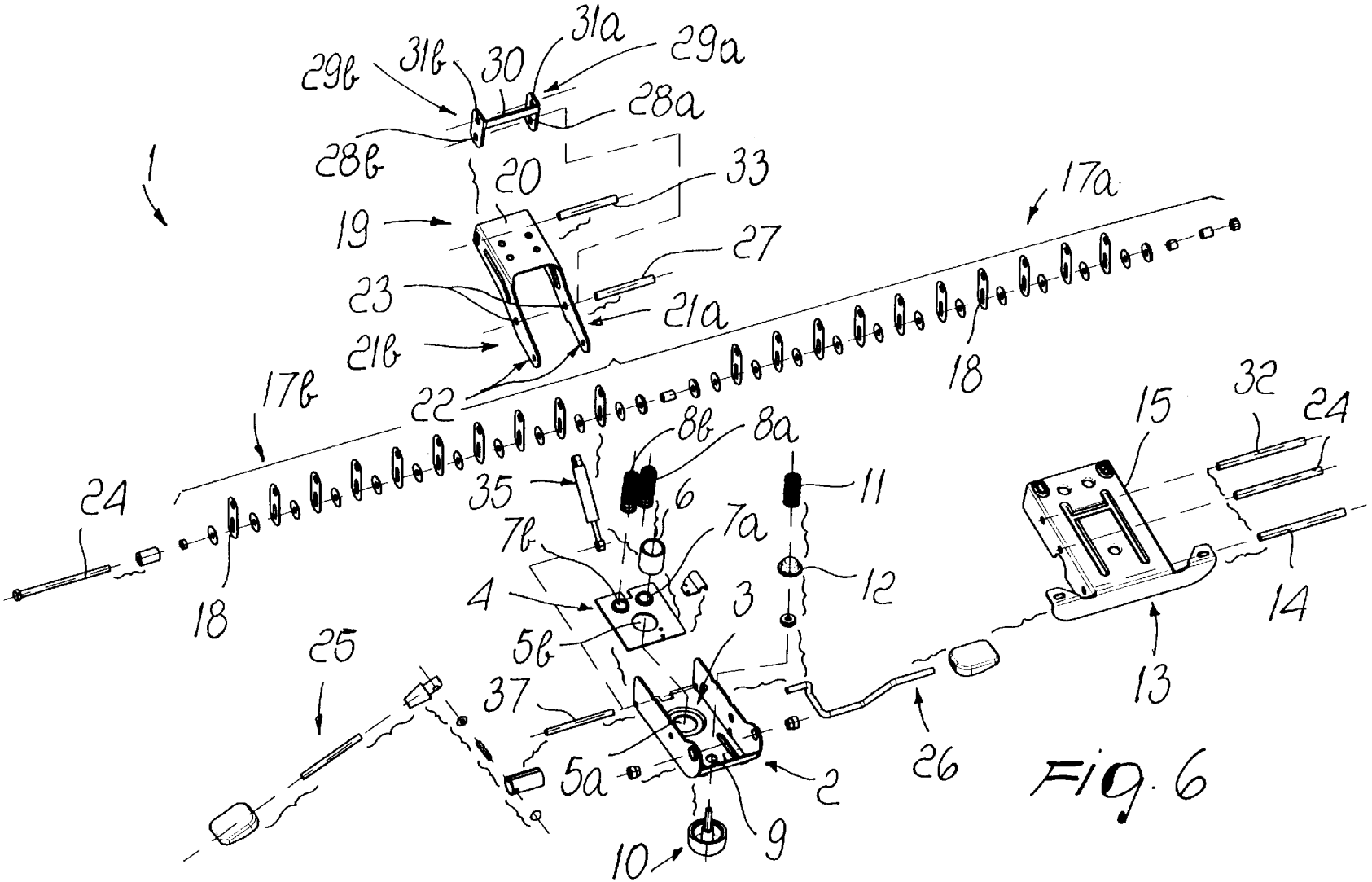
FIG. 6 is an exploded view of the components of the mechanical device.

On the opposite side with respect to the vertex of the plate 4 there are two first raised portions 7*a* and 7*b* (see FIG. 6) which act as seats for positioning a pair of cylindrical helical compression springs 8*a* and 8*b*.

A first threaded seat 9 or a hole is also formed on the first base 3, in a region not affected by the plate 4, for the complementarily shaped stem of a knob 10 whose rotation forces the compression of a second spring 11 which is arranged coaxially to a cap 12 which is associated with the end of the stem of the knob 10.

Moreover, the mechanical device is constituted by a second seat fixing bracket 13 which also has a box-like structure.

The first bracket and the second bracket are mutually pivoted transversely by means of a first pivot 14 which passes at suitable seats formed at the ends of the first and second brackets which lie opposite the one adjacent to the plate 4; the articulation is freely movable.

The second bracket 13 is approximately as long as the underlying first bracket 2 and wider than said first bracket and has a second base 15 for resting the ends of the pair of springs 8*a* and 8*b* and of the second spring 11.

Two pairs of laminar elements, designated by the reference numerals 17*a* and 17*b*, are pivoted transversely to the second bracket 13 by means of a second pivot 16 and have, at their other end, a suitable longitudinal slot 18.

The mechanical device is also constituted by a third bracket 19 which is also box-like, so as to form a third base 20 which has anchoring means for the backrest and two lateral wings 21*a* and 21*b* which have two second holes 22 formed at the free end and two third holes 23 formed in an intermediate region.

At the second holes 22, the third bracket 19 is pivoted, by means of a third pivot 24, to the first bracket 2; the third pivot 24 acts at the slots 18 of the pair of laminar elements 17*a* and 17*b*.

Means are provided in order to allow the packing of the pairs of laminar elements, which accordingly act as means suitable to lock the mutual positioning of the seat and the backrest.

For this purpose there is provided a first lever 25, whose rotation produces the packing or spacing of the pair of laminar elements, and there is provided a second lever 26 whose upward motion causes its end that lies above the bush 6 to interact with the gas piston located on the central column.

The third bracket 19 is also pivoted, at the third holes 23, to a fourth pivot 27 which also affects fourth holes 28*a* and 28*b* of a pair of linkages 29*a* and 29*b* which are mutually connected by a cross-member 30.

Moreover, said two linkages have fifth holes 31*a* and 31*b* at which it is possible to arrange a fifth pivot 32 for pivoting to the second bracket 13.

The body 34 of a piston 35 is transversely freely pivoted, by means of a sixth pivot 33, at the free end of the third bracket 19; the stem 36 of said piston is in turn pivoted, by means of a seventh pivot 37, transversely to the end of the first bracket 2 that lies below the plate 4 and the springs 8*a* and 8*b*.

Use of the mechanical device is therefore as follows: once the first bracket 2 has been associated by arranging the bush 6 at the central column, which protrudes from a rotating base, and once the backrest has been associated at the third bracket 19 and the seat has been associated at the third bracket 19, a synchronous movement between the seat and the backrest is achieved once pressure between the pair of laminar elements 17*a* and 17*b* is released by virtue of the first lever 25.

The mechanical device can therefore be likened to an articulated quadrilateral, in which the presence of the linkages 21*a* and 21*b* further links the movement of the third bracket 19 and of the second bracket 13, the interaction between the third bracket 19 and the first bracket 2 occurring purely by pivoting thereto at the third pivot 24 and by virtue of the interposition and connection of the piston 35.

This structure allows a more gradual synchronous mutual movement of the seat and the backrest; this improvement is also allowed by the presence of the springs 8*a* and 8*b*, which are axially offset with respect to the axis of the bush 6.

The pivoting of the end of the third bracket 19 to the first bracket 2 by virtue of the third pivot 24 further allows the mechanical device to pass the tests prescribed by current standards without forcing the lateral wings 21*a* and 21*b* of the third bracket 19 to have particular hardness characteristics, is since they are not subjected to any sliding and are therefore not subjected to possible wear and/or breakage.

The materials and the dimensions that constitute the individual components of the device may of course be the most pertinent according to specific requirements.

The disclosures in Italian Utility Model Application No. TV98U000026 from which this application claims priority are incorporated herein by reference.

What is claimed is:

1. A mechanical device for the synchronous movement of a seat and a backrest of a chair, comprising a first supporting bracket for attachment to a central column which protrudes from a rotating base and is pivoted transversely to an end of a second fixing bracket for attachment of said seat and which cooperates with two spaced apart pairs of slotted laminar elements which are pivoted to said first bracket and comprising a third anchoring bracket for attachment of said backrest, wherein said third bracket is pivoted to said first bracket and to a pair of linkages which are in turn pivoted to said second bracket, a piston being interposed between said third and first brackets, and a pair of helical compression springs being interposed between said first and second brackets.

2. The device according to claim 1, wherein said first supporting bracket has a first base above which a plate is arranged along part of its length, said first base and said plate having first holes for positioning of a bush at which an end of a stem of a central wheeled column is associated, said plate being slightly inclined with respect to said first base so as to form an acute angle therewith, assuming as positive a counterclockwise rotation and a vertex directed away from said first holes.

3. The device according to claim 2, wherein two first raised portions are provided on an opposite side with respect to said vertex of said plate and act as seats for positioning of said two cylindrical helical compression springs.

4. The device according to claim 2, wherein on said first base, in a region not affected by said plate, there is a first threaded seat or hole for a complementarily shaped stem of a knob whose rotation forces compression of a third spring which is arranged coaxially to a cap which is associated with a tip of the stem of said knob.

5. The device according to claim 2, wherein said first and second brackets are mutually transversely articulated by means of a first pivot which passes at suitable seats formed at ends of said first and second brackets that lie opposite to an end adjacent to said plate, the articulation being freely moveable.

6. The device according to claim 4, wherein said second bracket is approximately as long as, and wider than, said underlying first bracket and has a second resting base for end portions of said pair of springs and of said third spring.

7. The device according to claim 2, wherein said two pairs of laminar elements are pivoted transversely at one end to said second bracket by means of a second pivot, said laminar elements having a suitable longitudinal slot at an opposite end.

8. The device according to claim 7, wherein said third bracket, which has a box-shaped configuration, has a third base which is provided with anchoring means for the back-rest and two lateral wings which have two second holes formed at a free end and two third holes formed in an intermediate region, said third bracket being pivoted to said first bracket at said second holes by means of a third pivot which acts at said slots of said pair of laminar elements.

9. The device according to claim 8, wherein said third bracket is pivoted, at said third holes, to a fourth pivot which also affects fourth holes of a pair of linkages which are mutually connected by a cross-member.

10. The device according to claim 9, wherein said pair of linkages has fifth holes at which it is possible to arrange a fifth pivot for pivoting to said second bracket.

11. The device according to claim 8, wherein the piston is transversely freely pivoted at a free end of said third bracket by means of a sixth pivot, a stem of said piston being in turn pivoted, by means of a seventh pivot, transversely to an end of said first bracket that lies below said plate and said pair of springs.

* * * * *